US007055443B2

(12) United States Patent
Goto et al.

(10) Patent No.: US 7,055,443 B2
(45) Date of Patent: Jun. 6, 2006

(54) EMBROIDERING MACHINE

(75) Inventors: Hisaharu Goto, Nagoya (JP); Mikio Furuichi, Kuwana (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 11/049,687

(22) Filed: Feb. 4, 2005

(65) Prior Publication Data

US 2005/0188906 A1 Sep. 1, 2005

(30) Foreign Application Priority Data

Feb. 6, 2004 (JP) ..... 2004-031034

(51) Int. Cl.
*D05B 21/00* (2006.01)

(52) U.S. Cl. ..... 112/102.5; 700/138

(58) Field of Classification Search ..... 112/102.5, 112/155, 470.06, 445, 458, 453, 470.01; 700/138, 136, 137
See application file for complete search history.

(56) References Cited

U.S. PATENT DOCUMENTS 4,453,477 A * 6/1984 Gerber ..... 112/102.5
4,869,188 A * 9/1989 Hyodo ..... 112/445

FOREIGN PATENT DOCUMENTS

JP 8-223373 8/1996
JP 2802395 7/1998

* cited by examiner

*Primary Examiner*—John Calvert
*Assistant Examiner*—Brian Kauffman
(74) *Attorney, Agent, or Firm*—Oblon, Spivak, McClelland, Maier & Neustadt, P.C.

(57) ABSTRACT

The present invention provides an embroidering machine which is made up of a thread station at which a plurality of spools of different colored threads are installed; a frame on which a work-piece is carried in tension mode; an embroidery stitching mechanism having a plurality of needles to which the colored threads are routed, respectively, and stitching the work-piece with the colored thread routed to a selected needle; a color recognizing device for recognizing the color of each of the threads routed to the respective needles; data reading means for reading embroidering data relating to the embroidering pattern; a comparing device matching a color indication included in the embroidering data with the color of each of the threads which is recognized by the color recognizing device, the comparing device selecting one of the threads to which the thread of the matched color is routed for determining the selected needle; and a control device for controlling the selected needle of the embroidery stitching mechanism and the frame to produce an embroidering pattern on the work-piece with the matched color thread. The color recognizing device includes an emitting portion from which a beam of light is emitted to the corresponding thread, a receiving a reflection beam of light reflected from the thread, and a light shielding device provided between the emitting portion and the receiving portion for the prevention of an entrance of light into the receiving portion except for the reflection beam of light.

6 Claims, 7 Drawing Sheets

FIG. 3

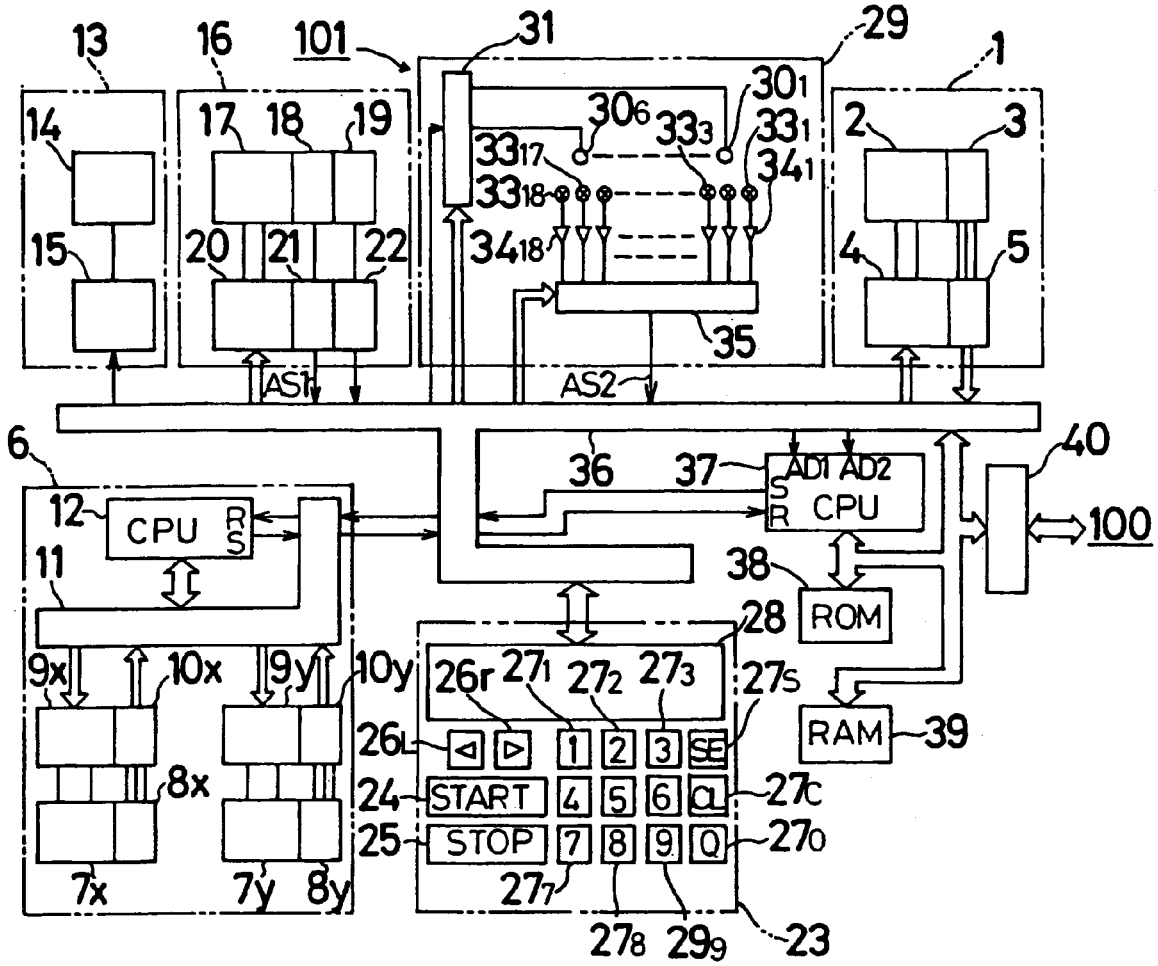

1 sewing machine driving device
2 sewing machine motor
3 encoder
4 motor driver
5 amplifier
6 embroidering frame driving device
7x X-drive motor
7y Y-drive motor
8x encoder
8y endocder
9x motor driver
9y motor driver
10x amplifier
10y amplifier
11 interface
13 thread cutting device
14 thread cutting solenoid
15 solenoid driver
16 needle selecting device
17 needle selecting motor
18 pressure sensitive element
19 HP switch
20 motor driver
21 amplifier
22 amplifier
23 operation board
28 2D display
29 thread color detecting device
31 analogue switch
35 analogue switch
36 interface
40 communication interface
100 data transmitting device 41 multiplex
42 commmunication interface
44 flexible disk device
45 disk driver
46 disk controller
47 display device
48 driver
52 interface

STEP

21 FRAME⇒ORIGINAL POINT
22 STITCHING DATA : READ OUT
23 THREAD CHANGE ?
24 MOTOR 2 : STOP
25 CSF = 1 ?
26 NEEDLE SELECTION
27 END ?
28 FRAME : DRIVE TO MOVE
29 MOTOR 2 : TURN ON
30 FRAME : READY FOR MOVE
31 STOP KEY : ON ?
32 RAM 39 READ-OUT : END ?
33 MOTOR 2 : STOP
34 REQUEST FOR SENDING NEXT STITCHING DATA
RAM 39 ←STITCHING DATA
35 MOTOR 2 : STOP

EMBROIDERING MACHINE

The present application is based on and claims priority under 35 U.S.C § 119 with respect to Japanese Patent Application No. 2004-031034 filed on Feb. 6, 2004 (the 16th Year of Heisei), the entire content of which is incorporated herein by reference.

BACKGROUND OF THE INVENTION

1. Field of the Invention

The present invention is generally directed to an embroidering machine and in particular to an embroidering machine which has a mechanism being capable of establishing automatic change of a thread to another.

2. Prior Art

One of the conventional embroidering machines of the type is disclosed in, for example, the Publication of Japanese Patent No. 2802395 issued on Jul. 17, 1998 (the 10th year of Heisei). This embroidery machine includes a thread station at which a plurality of thread-wound spools are installed, a selecting mechanism which selects a thread wound on one of the spools, an embroidery stitching mechanism having a plurality of needles for producing an embroidering pattern on a work-piece with the selected thread, a driving mechanism for driving a frame which carries the work-piece in tension mode, a data processing means for reading data related to the embroidering pattern from a recording medium, a thread changing control means which designates a thread to be selected to the selecting mechanism, and a frame driving control means which orders the driving mechanism to drive the frame on the basis of the read data. The above-mentioned thread change is performed, only when the read date is indicative of thread change, by an interruption of the embroidering stitching operation and subsequent either of automatic needle change and automatic thread change pursuant to either of a needle number and a thread number (i.e. a position of spool at the thread station) which are stored in the read data.

In the conventional or above-mentioned structure, for producing a specific embroidering pattern on the work-piece, each of the needles has to be routed with a designated colored thread. If one of the needles is routed with a wrong colored thread, a different or unexpected embroidering pattern is produced on the work-piece. In addition, after producing an embroidering pattern, sometimes another embroidering pattern may be produced on the same or another work-piece. In such a case, at least one of the colored threads routed to a specific needle has to be replaced with another colored threads, which may result in that a wrong colored thread is routed to the specific needle. That is, whenever with a specific embroidering machine different embroidering patterns are produced on a common work-piece or different work-piece, an operation for routing at least a colored thread from a specific needle to another needle is inevitably requested and checking whether such a thread route changing operation has been done correctly is also necessary.

The above-mentioned cumbersome can be seen whenever, with a specific embroidering machine having single needle, a different embroidering patterns are produced on a common work-piece or different work-pieces.

A need exists to provide an embroidering machine which is free from the above-described drawbacks.

SUMMARY OF THE INVENTION

Accordingly, in order to meet the above need, a first aspect of the present invention is to provide an embroidering machine comprises:

- a thread station at which a plurality of spools of different colored threads are installed;
- a frame on which a work-piece is carried in tension mode;
- an embroidery stitching mechanism having a plurality of needles to which the colored threads are routed, respectively, and stitching the work-piece with the colored thread routed to a selected needle;
- a color recognizing device for recognizing the color of each of the threads routed to the respective needles;
- data reading means for reading embroidering data relating to the embroidering pattern;
- comparing device matching a color indication included in the embroidering data with the color of each of the threads which is recognized by the color recognizing device, the comparing device selecting one of the threads to which the thread of the matched color is routed for determining the selected needle;
- control means for controlling the selected needle of the embroidery stitching mechanism and the frame to produce an embroidering pattern on the work-piece with the matched color thread.

A second aspect of the present invention is to provide an embroidering machine whose gist is to modify the structure of the first aspect, wherein the color-recognizing device includes an emitting portion from which a beam of light is emitted to the corresponding thread, a receiving a reflection beam of light as a reelection of the emitted beam of light from the thread, and a light shielding device provided between the emitting portion and the receiving portion for the prevention of an entrance of light into the receiving portion except for the reflection beam of light.

A third aspect of the present invention is to provide an embroidering machine whose gist is to modify the structure of the first aspect, wherein the color recognizing device is adjustable relative to the corresponding thread.

A fourth aspect of the present invention is to provide an embroidering machine whose gist is to modify the structure of the second aspect, wherein the light shielding device is in the form of a cylindrical member, the emitting portion is placed at an inside portion of the cylindrical member, and the receiving portion is placed at an outside portion of the cylindrical member.

A fifth aspect of the present invention is to provide an embroidering machine which comprises:

- a thread station at which a plurality of spools of different colored threads are installed;
- a frame on which a work-piece is carried in tension mode;
- an embroidery stitching mechanism having one needle to which one of the colored threads is routed and stitching the work-piece therewith;
- a color recognizing device for recognizing the color of the thread routed to the needle;
- data reading means for reading embroidering data relating to the embroidering pattern;
- control means for controlling the selected needle of the embroidery stitching mechanism and the frame to produce an embroidering pattern on the work-piece with the matched color thread; and
- comparing device matching a color indication included in the embroidering data with the color of the thread which is recognized by the color recognizing device, the comparing device allowing the control means to operate if the matching reveals that the color indication is in coincidence with the thread color.

A sixth aspect of the present invention is to provide an embroidering machine whose gist is to modify the structure of the fifth aspect, wherein the color recognizing device includes an emitting portion from which a beam of light is emitted to the corresponding thread, a receiving a reflection beam of light as a reelection of the emitted beam of light from the thread, and a light shielding device provided between the emitting portion and the receiving portion for the prevention of an entrance of light into the receiving portion except for the reflection beam of light.

A seventh aspect of the present invention is to provide an embroidering machine whose gist is to modify the structure of the fifth aspect, wherein the color recognizing device is adjustable relative to the corresponding thread.

An eighth aspect of the present invention is to provide an embroidering machine whose gist is to modify the structure of the sixth aspect, wherein the light shielding device is in the form of a cylindrical member, the emitting portion is placed at an inside portion of the cylindrical member, and the receiving portion is placed at an outside portion of the cylindrical member.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which;

FIG. 3 is a block diagram of a control device of the embroidering machine shown in FIG. 1;

DETAILED DESCRIPTION OF THE PRESENT INVENTION

Hereinafter, an embodiment of an embroidering machine according to the present invention will be described in great detail with reference to the attached drawings.

Figure 1:
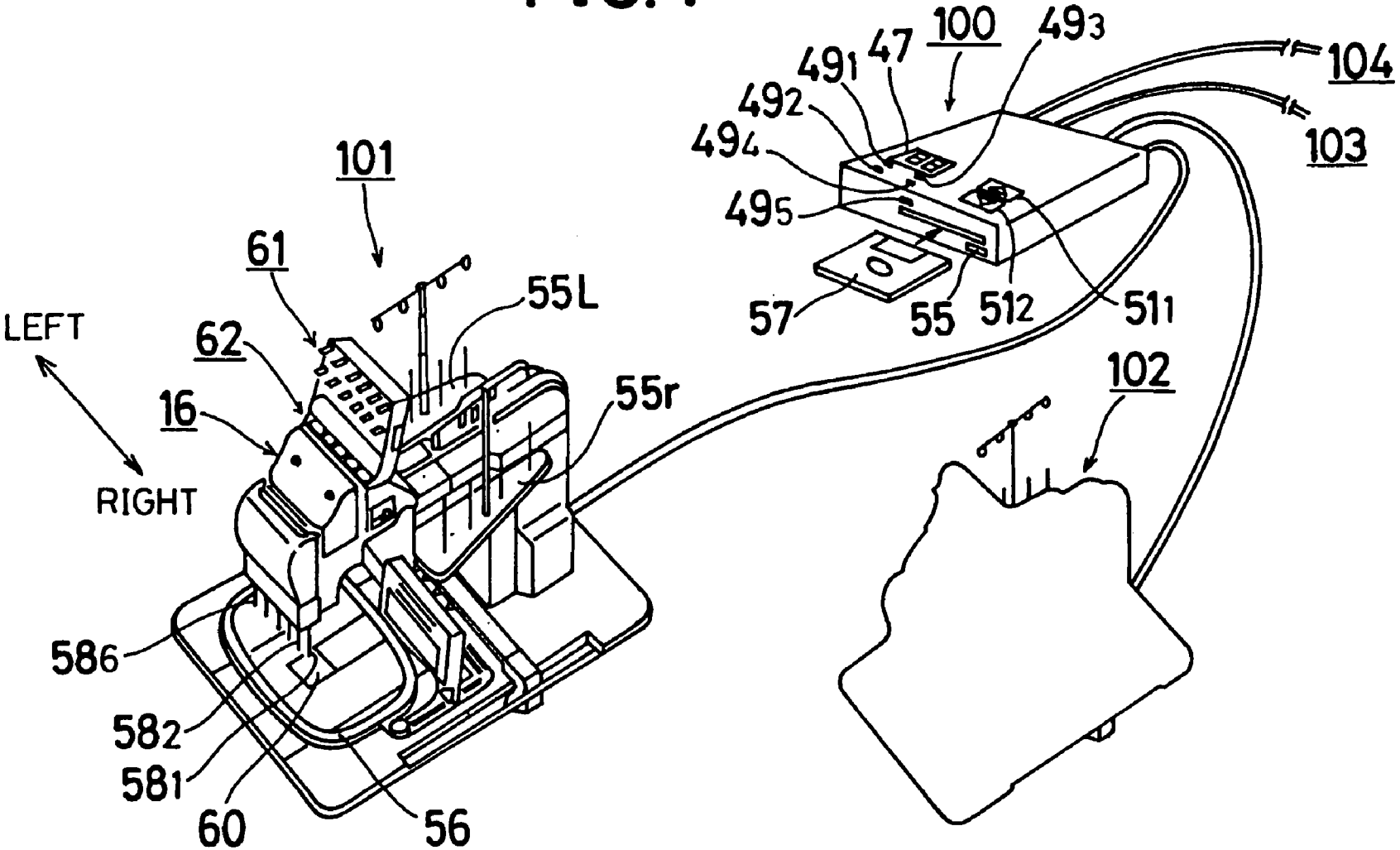
FIG. 1 is a perspective view of an embodiment of an embroidering machine according to the present invention.

First of all, with reference to FIG. 1, there is illustrated an embroidering system which includes as maximum as four embroidering machines 101, 102, 103, and 104 each of which is fed with embroidering data from a data transmitting device 100 having a built-in flexible disk device 44. Employing such a flexible disk device 44 makes it possible to establish quick data transfer to the embroidering machines 101, 102, 103, an d 104 after inserting a flexible disk 57 recording therein embroidering data into the device 44.

The four embroidering machines 101, 102, 103, and 104 are identical with each other in construction and operation. The embroidering machine 101, which will be described in extensive detail, includes an embroidering frame driving device 6 which serves for establishing an in-horizontal-plane 2D (X-Y direction) movement of an embroidering frame 56, an embroidering stitching mechanism 1 having a plurality of needles 581 through 586, and a needle selecting device 16. The needle selecting device 16 selects a designated needle from the plural needles 581 through 586 to which different colored threads are provided or routed, respectively. The designated needle is transferred to a position that is just above a needle throat 60 and is brought into vertical reciprocation movement to produce an embroidering pattern on a work-piece W with the colored thread provided to the designated needle.

The embroidering machine 101 has a sewing arm 101*a* to which a pair of split type threads stations 55R and 55L. Each of the thread stations 55R and 55L is capable of installing up to four thread spools. Thus, a total of eight thread spools can be installed on both the thread stations 55R and 55L. Of the eight spools, six thread spools 691 through 696 are available. Each of the six different colored threads is routed from the spool to the corresponding needle by way of a thread tension device 61, a hole of a thread guide 62, and an eyelet of a thread take-up lever.

Figure 2:
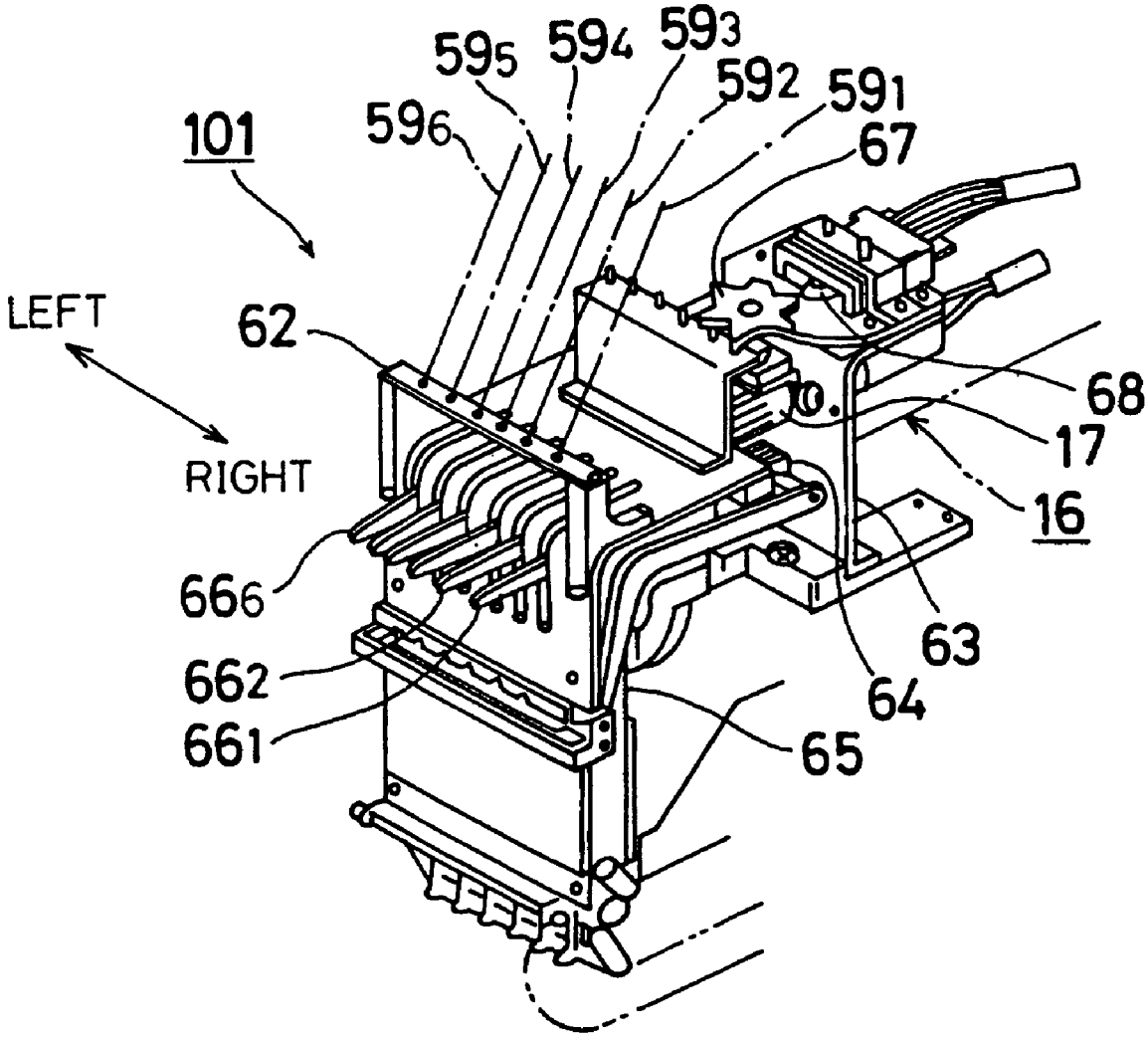
FIG. 2 is a perspective view of a needle selection device of the embroidering machine shown in FIG. 1.

Referring now to FIGS. 2 and 3, the needle selecting device 16 has a carriage 65 secured to a fixing frame 53. The fixing frame 63 is movable along an extending direction of a rack 64 secured to the fixing frame 63. The carriage 65 holds therein needles bars (not shown) carrying the respective needles 581 through 586, the tread take-up levers 666 and other elements that are required for embroidering and thread feeding operations.

The carriage 65 is provided with a needle selecting motor 17 and a reducer (not shown) driven by the motor 17. The reducer has an output shaft on which a pinion (not shown) is fixedly mounted. This pinion is in meshing engagement with the rack 64. When the motor 17 is turned on in normal direction (reverse direction), the carriage 65 is brought into movement in the right (left) direction. A limit position switch 19 that is also referred to as a home position switch is secured to the fixing frame 63. The limit switch 19 is designed to turn on or off by the carriage 65 when the carriage 65 is transferred to its fully left position at which the first needle 581 offsets slightly in the left from an over-head point of the throat plate 60.

On the fixing frame 63, there is provided a widely pitched gear-cam 67. The gear-cam 67 is brought into rotation when one of distal ends thereof is engaged with one of six pins that corresponds to the six needles is arranged in align mode along the right-and-left direction. While one of the distal ends of the gear-cam 67 is being in engagement with one of the six pins, another distal end applies a maximum force to a pressure-sensitive application member 68, thereby pressing a pressure-sensitive element 68 (FIG. 3).

If the carriage 65 is moved to the right from its home position at which the first needle 581 offsets slightly in the left from an over-head point of the throat plate 60 in FIG. 1, the six pins are, in turn, brought engagement with the gear-cam 67, which causes the pressure-sensitive element 18 to produce a high peak voltage (a low peak voltage) whenever each of the needles 581 through 586 (a mid-portion between two adjacent needles) takes a position just above the throat plate 60. Thus, counting the occurrence of the high peak voltage makes it possible to identify which needle is just above the throat plate 60. For example, turning off the movement of the carriage when the counted number is 1, the first needle 581 is placed just above the needle throat 60.

Figure 7:
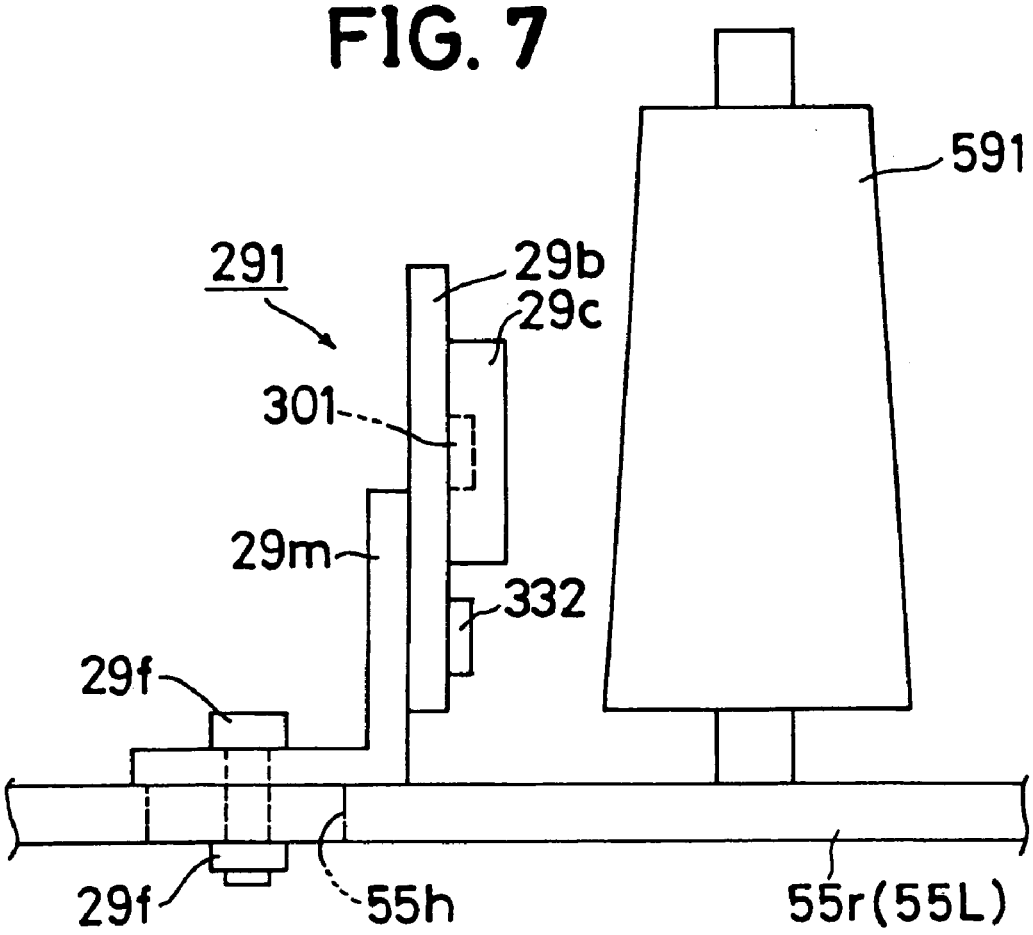
FIG. 7 shows how a color recognizing device is placed on a thread station.
Figure 8:
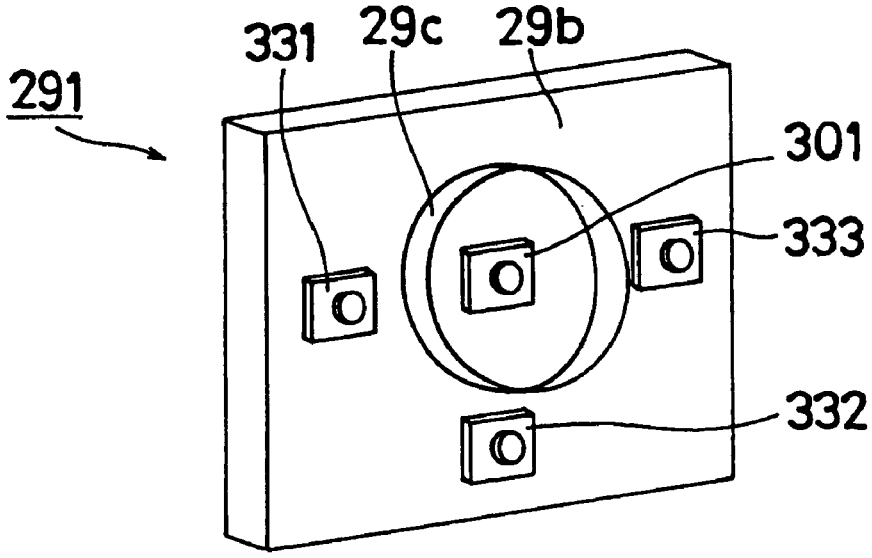
FIG. 8 is a perspective view of the color recognizing device shown in FIG. 7.

Other than the above-described devices, the embroidering machine 101 includes other devices such as a color recognizing device 29. As shown in FIGS. 7 and 8, the color recognizing device 29 is made up of six (first-sixth) color detecting units 291 through 296 (only one is illustrated for the simplicity). The color detecting units 291 through 293 are provided on the thread station 55R, while the color detecting units 294 through 296 are provided on the thread station 55L. The first color detecting unit 291 includes a light emission element 301 that emits a beam of light to the thread 591 that is routed to the first needle 581, and light receiving elements 331, 332, and 333. The color recognizing device 29 serves, at the thread stations 55R and 55L, for recognizing the color of each of the threads 591 through 596 that are routed to the respective needles 581 through 586.

The light emission element 301 and the light receiving elements 331, 332, and 333 are provided on a plate 29*b* secured to a vertical wall of an L-shaped bracket 29*m*. The light receiving elements 331, 332, and 333 are positioned to receive a beam of light reflected from the thread 591. A circular cylindrical cover member 29*c* formed of opaque material is so provided on the vertical wall of the plate 29*b* as to enclose the light emission element 301, thereby preventing a direct entrance of the beam of light from the light emission element 301 to the light receiving elements 331, 332, and 333. That is to say, no lights other than the beam of light reflected from the thread 591 are prevented from entering the light receiving elements 331, 332, and 333, thereby not lowering the color reorganization precision of the color detection unit 291. In other words, the cover 29*c* allows only the beam of light reflected from the thread 591 to enter the light receiving elements 331, 332, and 333. Such a structure is effective in enhancing the precision of the color detection unit 291 in color reorganization. It is to be noted that so long as only the beam of light reflected from the thread 591 is allowed to enter the light receiving elements 331, 332, and 333 the shape of the cover 29*c* is not restricted.

The L-shaped bracket 29*m* is connected at its horizontal wall to the thread station 55R(55L) by mean of a connecting device. The connecting device includes a bolt 29*f* and a nut 29*g*. Fixing the bolt 29*f*, after passing through a slot 55*h* in the thread station 55R(55L), with the nut 29*g* makes it possible to slide the plate 29*b* which carries the optical elements for adjusting the position thereof relative to the thread 591.

Other color detection units have a structure similar to the above-described structure of the first color detection device 291. As a whole, other than the light emission element 301 and the light receiving elements 331, 332, and 333, color recognizing device 29 further includes light emission elements 302 through 306 and light receiving elements 34 through 318.

Signals issued from the light receiving elements 301 through 318 are fed, after being amplified at respective amplifiers to calibrate, a second A/D input port AD2 by way of a selectively operated analogue switch 35 and an interface 36.

The CPU 37 orders, when a color reorganization is required, an analogue switch 31 to turn on or illuminate the light emission element 301, converts the color separation signals from the respective light receiving elements 301 through 303 into digital signal to read, creates color information data by executing a specific formula after inputting therein the read digital signal data, and stores the resulting color information data into a first register as a portion of an in-RAM table NNR. Similar calculations are made with respect the other color detection units 292 through 296.

Figure 4:
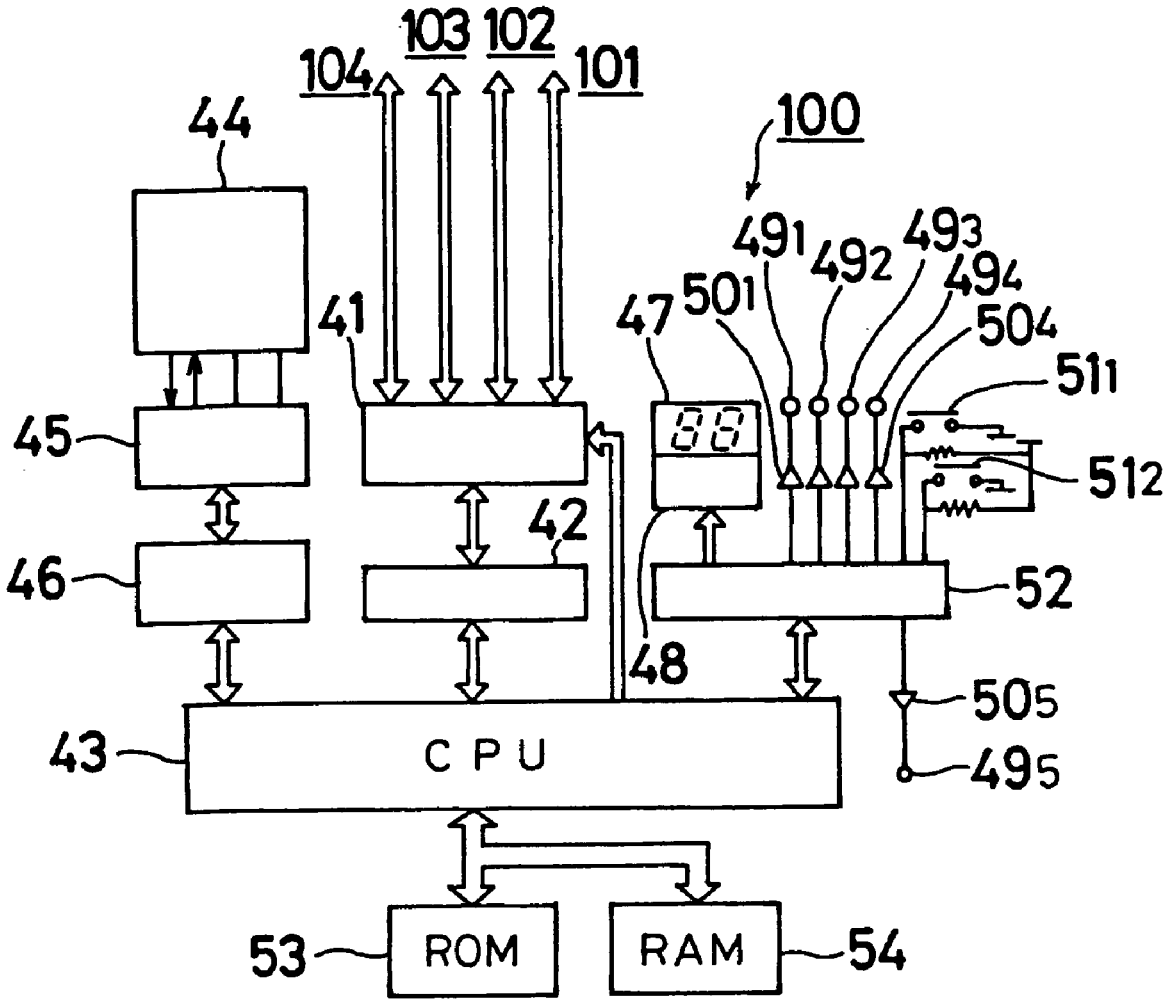
FIG. 4 is a block diagram of a data transmitting device of the embroidering machine shown in FIG. 1.

Referring to FIGS. 1 and 4, as previously described, the data transmitting device 100 reads the embroidering data stored in the flexible disk 57 inserted in the flexible disk device 44 and transmits the embroidering data to the embroidering machines 101 through 104. The data transmitting device 100 includes a disk driver 45, a disk controller 46, a multiplex 41, a communication interface 42, a CPU 43, a ROM 53, and a RAM 54. The multiplex 41 is in communication with the embroidering machines 101 through 104, which makes it possible to transmit the embroidering data to the embroidering machines 101 through 104. The multiplex 41 supervises the current stage of this data transmission such as how degree the data transmission proceeds or which transmission of the embroidering data has been completed.

The CPU 43 is connected via an interface 52 with a display device 47 with its driver 45 for indicating an identification number of the embroidering data which is under transmission or which has been transmitted to the embroidering machines. The CPU 43 is also connected via the interface 52 with switches 511 and 512 for designating data formats, indicating elements 491 and 492 for indicating designated formats, an error indicating element 493, an indicating element 494 for indicating an under-transmission condition, and an indicating element 495 for indicating an under-read condition under which the flexible disk 57 is being accessed. It is to be noted that the flexible disk device 57 has a disk eject button 55*a* shown in FIG. 1.

In the flexible disk 57, there are stored a host of embroidering information as to plural embroidering patterns. Each piece of embroidering information is identified wit its proper number. Each piece of information is made up of a small quantity of supervise data and a large quantity of stitching data. The supervise data include thread color data and thread color selecting sequence data. The stitch data are divided into two categories, control data and frame movement amount data. The control data include thread change order data, end (termination of the embroidering operation) order data. The frame movement amount data indicates displace amounts (X-directional and Y-directional amounts) that are measured from the position of the frame when the latest embroidering operation was terminated. It is to be noted that in case of the first operation of the embroidering machine this position is the just above the throat plate 60. The stitch data is in the form of a host of sequentially arranged for one-stitch data. In the sequence, thread change instruction data is inserted as required. The end of this sequence is end indication data.

The CPU 43, when one of the embroidering machines 101 through 104 begins to issue an request signal for mutual communication by way of the multiplex 41 and the communication interface 42, causes the multiplex 41 to select a communication line through which the request signal was transmitted and beings to establish a communication to the embroidering machine from which the signal was issued. This mutual communication is known from Japanese Patent Publications Sho. 61(1986)-24953 and Sho. 61(1986)-24954.

Referring back to FIG. 3, the interface 36 is connected with an operation board 23 on which are provided a set of ten keys 270 through 279 and clear key 27*c* which are used for entering the embroidering pattern number, a set key 27*s* for requesting transfer of embroidering information (i.e. for indicating a completion of inputting embroidering pattern number), rightward shift and leftward shift indication keys 26R and 26L for manual needle selections, a start indication key 24, a stop indication key 25, and a liquid-crystal 2D display 28.

Figure 5:
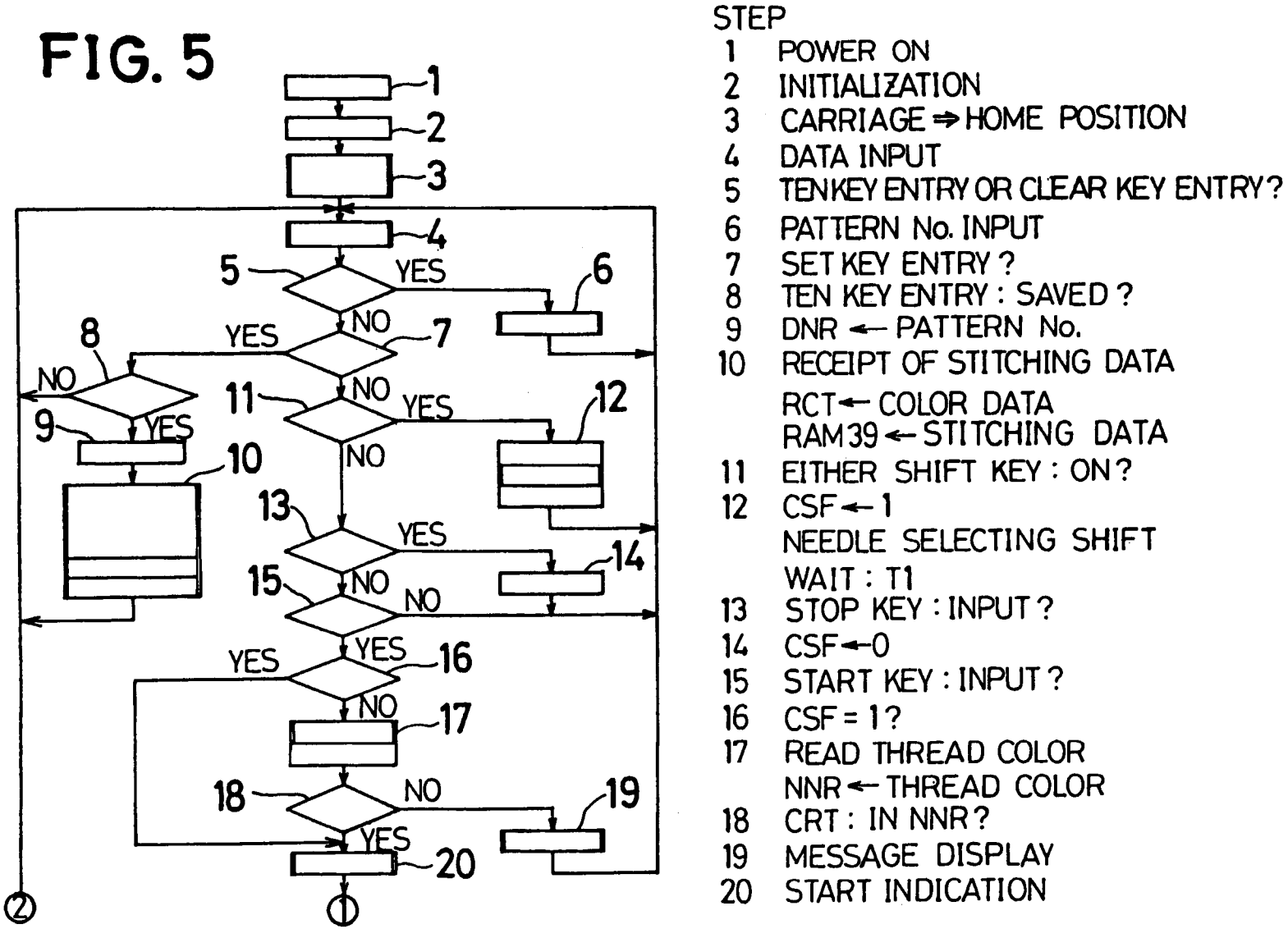
FIGS. 5 and 6 show flowcharts that are indicative of how a CPU of the control device operates.

FIGS. 5*a* and 5*b* depict how the CPU 37 controls the embroidering operation in response to various key entries from the operation board 23.

First of all, with reference to FIG. 5*a*, as soon as an electric power source (not shown) is turned on (step 1), the CPU 37 initializes the system (step 2). In the initialization, the output of the interface 36 is set to be a specified output level that is required in waiting mode.

Next, the CPU 37 reads the condition of the home position switch 19 and causes the motor 17 to drive in reverse direction fro the leftward movement of the carriage if the condition is high level H which means that the switch 19 is open and the carriage 65 is not at its home position (step 3).

Then, the system becomes waiting mode to wait any command entry from the operation board 23 (step 4). Upon data entry or input from any one of the ten keys 270 through 279, the corresponding numeral value is saved in the inner resister. Upon entry from the clear key 27*c*, the sorted data are initialized to zeros (steps 5 and 6).

In case of an input from the set key 27*s*, it is cheeked whether or not the ten key input has been saved (steps 7 and 8). If ten key entry is not found i.e. the embroidering pattern number was not inputted, the system retunes to step 4. Otherwise, the ten-key entry number is saved in the embroidering pattern number resister DNR (step 9) and step 10 is performed as follows: The CPU 37 requests the data transmitting device 100 to communicate and transmits the embroidering pattern number stored in the resister DNR to request to transfer of the stitching data corresponding to the embroidering pattern number. The CPU 43 of the data transmitting device 100, in response to this request, stores the received embroidering pattern number in a resisted used for the embroidering machine 101 (the communication line number of the multiplex 41) and stores therein the date in the flexible disk 57 which includes the supervise data, the stitching data and the last address of the stitching data.

Upon receipt of the supervise data and the stitching data, the CPU 37 stores the supervise data and the stitching data into a resister and a RAM 39, respectively, and checks whether or not the RAM 39 has an empty area above a set bytes. If so, the CPU 37 requests to transfer of further data from the data transmission device 100 repeatedly so long as the empty area exceeds the set bytes and the CPU 37 does not receives the embroidering pattern end data.

When the RAM 39 becomes not to store further data or is stored with the embroidering pattern end data, the system retuns to step 4 for waiting a manipulation of the start key 24.

In step 4 for "Read Input" processing, upon data entry from the rightward shift key 26R or the leftward shift key 26L the CPU 37 reads an ON-signal to write "1" that indicates an designation of manual needle selection in a resister CSF. Otherwise, an designation of automatic needle selection is regarded. In case of data entry from rightward shift key 26R, the needle selection motor 17 is turned on in normal direction to move the carriage in the rightward direction. During such a movement of the carriage, the resulting analogue output signal issued from the pressure sensitive element 18 is converted in digital mode to be read by the CPU 37. The CPU 37 stops the motor 17 when the high peak point value of the signal is found that comes from the pressure sensitive element 18 and the value in a needle number resister is added with 1. On the other hand, in case of data entry from leftward shift key 26L, the needle selection motor 17 is turned on in reverse direction to move the carriage in the lefttward direction. During such a movement of the carriage, the resulting analogue output signal issued from the pressure sensitive element 18 is converted in digital mode to be read by the CPU 37. The CPU 37 stops the motor 17 when the high peak point value of the signal is found that comes from the pressure sensitive element 18 and the value in the needle number resister is added with 1. It is to be noted that the numeric value in the needle number resister is representative of the needle number that is located just above the throat plate 60. For example, if the numeric value in the needle number resister is "i", the needle 58*i* is located just above the throat plate 60. After the above-described carriage shift drive or movement of a distance that is in equivalent with a pitch between two adjacent needles, the system retunes to step 4 after a time elapse of T1. Even after time elapse of T1, if the ON-signal remains resulting from a long-time continuous press-on of either of the rightward shift key 26R and the leftward shift key 26L, the CPU 37 continues to execute the above-described the shift drive of the carriage.

Whether the rightward shift key 26R or the leftward shift key 26L is pressed on means that the operator himself/herself has decided to select a needle in manual mode. In such a case, without execution of an automatic needle selection operation (steps 25 and 26) that will be detailed later, an embroidering operation is made with the selected needle to produce one or more embroidering patterns on the work-piece. After selection of needle selection in manual mode as a result of pressing-on of either of the rightward shift key 26R and the leftward shift key 26L, if the stop key 25 is manipulated or pressed on, the CPU 37 clears the resister CSF to store "0" therein (step 14), thereby designating the automatic needle selection. Thereafter, the automatic needle selection operation is executed (steps 25 and 26).

Upon data entry from the start key 24, the CPU 37 checks the content of the resister CFS (step 16). If the content is "0" that indicates the automatic needle selection, the CPU 37 detects, with the color recognizing device 29, the colors of the respective threads 591 through 596 and the resulting six pieces of thread color information are stored in respective registers in a detected thread color table NNR (step 17). In this thread color detection procedure (step 17), the CPU 37 causes the light emission elements 301 though 306 of the color recognizing device to illuminate in sequential mode. While one of the light emission elements 301 though 306 is being lit, the CPU 37 receives, as digital mode, levels of the lights received at the corresponding three light receiving elements. The CPU 37 checks whether or not the levels are in excess of a set or predetermined value. If so, color data is generated to store in the table NNR. If not, no-existence of thread is regarded and non-thread data is generated to store in the table NNR. The contents of the table NNR are displayed on the display 28.

Though not detailed, upon data entry from the control board 23, the CPU 37 displays the corresponding data on the display 28. In addition, the data in the aforementioned table RCT and other pieces of data are also displayed on the display 28 immediately upon receipt thereof from the data transmitting device 100.

Next, the CPU 37 checks, in step 18, whether or not the required thread colors indicated by the contents of the table RCT are stored in the table NNR (i.e. are found on the threads routed to the respective needles). If so, the CPU 37 displays, on the display 28, a message saying "Initiation of Embroidering Operation". If not, the CPU 37 displays, on the display 18, an indication of alarm mark and a message saying "Thread Setting Error! Replace Thread of color X on the N-th needle with Thread of color Y (step 19). Then, the system returns to step 4. Upon appearance of such messages, the operator replaces the wrong colored thread with the correct colored thread and re-manipulates the start key 24.

Figure 6:
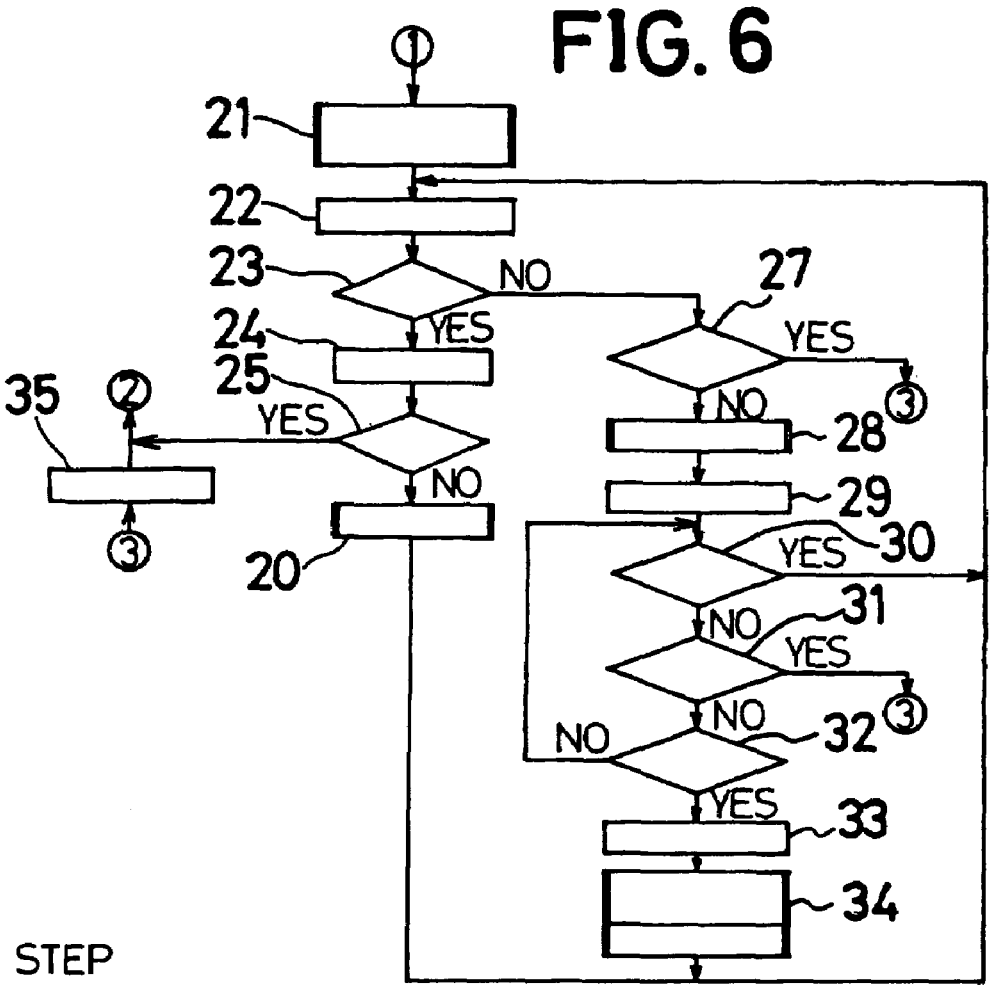

If the content of the register CSF is "1" which indicates manual needle selection or if the content of the register CSF is "0" which is accompanied by that all the thread colors indicated by the contents of the table RCT are stored in the table NNR, the CPU 37 indicates an initiation of embroidering operation on the display 28 (step 20) and executes an embroidering operation routine as detailed in FIG. 6.

Referring now to FIG. 6, at step 21, the CPU 37, first of all, orders the frame driving device 6 to determine an original point of the frame 56. The frame driving device 6, in obedient to this order, moves to and stop the frame 56 at a position at which the center point of the frame 56 is in coincidence with the just above of the throat plate. This position is regarded as the original point if the frame 56.

Next, the CPU 37 reads out the most leading-positioned stitching data from the RAM 39 which indicates a distance of the frame from the original point to a first stitching position (step 22). The read-out stitching data is fed from the CPU 37 to the driving device 6 to move the frame 56 in X and Y directions, thereby placing the frame 56 to the first stitching position (step 28). Upon confirmation of the transfer completion of the frame 56 to the first stitching position, the CPU 37 beings to turn on the motor 2 (step 29).

Thereafter, the CPU 37 waits a specific signal level issued from an encoder 3 that represents a permission to drive the frame 56 (step 30). During this waiting mode, it is checked whether or not the stop key 25 is manipulated (step 31) and whether or not the data read-out is completed (step 32). If the specific signal level comes from the encoder 3 subject to that the both results of steps 31 and 32 are false, the frame 56 becomes ready for operation and the followings are executed.

(a) The next stitching data is read out from the RAM 39 and is cheeked whether the resulting stitching data is the thread change data, the end data, or the frame movement amount data (steps 23 and 27).

(b) If the read-out stitching data is the frame movement amount data, the CPU 37 feeds this data to the driving device 6 to move the frame 56 in X and Y directions (step 28). Upon confirmation of the transfer completion of the frame 56, the CPU 37 beings to turn on the motor 2 (step 29).

Thereafter, the CPU 37 waits the specific signal level issued from an encoder 3 that represents the permission to drive the frame 56 (step 30). During this waiting mode, it is checked whether or not the stop key 25 is manipulated (step 31) and whether or not the data read-out is completed (step 32). If the specific signal level comes from the encoder 3 subject to that the both results of steps 31 and 32 are false, the frame 56 becomes ready for operation and the above operation (a) is executed.

(c) If the read-out stitching data is the thread change data, the CPU 37 turns off the motor 2 and checks the contents of the resister CSF (step 25). If the result of step 25 is "1" that indicates manual needle selection, the CPU 37 display an message for thread change requirement on the display 28 and causes the system to return to step 4. According to this on-screen message, the operator begins to manipulate one of the shift keys 26R and 26L to place the needle to which the required-colored thread is routed just above throat plate 60. and press the start switch 24 on.

If the content of the resister CSF is "0" that indicates the automatic needle selection, the CPU 37 executes step 26 for needle selection. In detail, the CPU 37 reads out the next thread color data from the table RCT and selects the number of the resister that has the same data as the read-out or next threads color data. Then, the number of the needle that is currently placed just above the throat plate 60 is subtracted by the number of one of other needles that is to be placed just above the throat plate 60 for the next embroidering. If the result of this subtraction is positive (negative), the motor 17 is turned on in reverse (normal) direction to shift the carriage in the leftward (rightward) direction. Then, the CPU 37 reads the resulting analogue signal issued from the pressure sensitive element 18, after being converted into digital mode and when the signal becomes its positive peak value subtracts one from the content in the needle number. If the content of the needle number resister is equal to the number of the needle that is to be used to the next embroidering operation, the CPU 37 turns of the motor 17. After completion of this needle selection procedure (step 26), the CPU 37 performs the above procedure (a).

(d) If the read-out stitching data is the end data, the CPU 37 turns off the motor 2 (step 35), displays an message of embroidering termination or completion on the display 28, and causes the system to go to step 4.

(e) While waiting the frame movement timing, if the CPU 37 recognizes a termination of read-out from the RAM 39, the CPU 37 turns off the motor 2 (step 33), requests the data transmitting device 100 for feeding subsequent stitching data, stores the resulting subsequent stitching data in the RAM 39, and requests the data transmitting device 100 for feeding further subsequent stitching data so long as a sufficient free space remains in the RAM 39. This request is made continually to store, whenever the data is transferred from the device 100, the transferred data in the RAM 39 until the CPU 37 receives the end data or the remaining free space of the RAM 39 becomes less than a set value (step 34). Thereafter, the CPU 37 performs the above procedure (a).

(f) While waiting the frame movement timing, if the CPU 37 recognizes that the stop key 25 is manipulated, the CPU 37 turns off the motor 2, displays a message of temporal stoppage on the display 28, and causes the system to return step 4.

Instead of the above-described embodiment in which the six needles 581 through 586 to which the respective colored threads are routed are provided with respective (six) color detection units that constitute the color recognizing device, the color recognizing device can be configured to have only one color detection unit, which is positioned to detect the color of the thread that is routed to the needle just above the throat plate 60. In such an alternative structure, step 17 should read as follows:

"the CPU 37 causes the carriage to place or transfer the needles 581 through 586, one by one, to a position just above the throat plate 60. Whenever each of the needles is placed at the position just above the throat plate 60, the color detection unit reads the color of thread routed to the needle at the position. The resulting color data is stored in the table NNR."

The invention has thus been shown and description with reference to specific embodiments, however, it should be understood that the invention is in no way limited to the details of the illustrates structures but changes and modifications may be made without departing from the scope of the appended claims.

What is claimed is:

1. An embroidering machine comprising:

a thread station at which a plurality of spools of different colored threads are installed;

a frame on which a work-piece is carried in tension mode;

an embroidery stitching mechanism having a plurality of needles to which the colored threads are routed, respectively, and stitching the work-piece with the colored thread routed to a selected needle;

a color recognizing device for recognizing the color of each of the threads routed to the respective needles, the color recognizing device including an emitting portion from which a beam of light is emitted to a corresponding thread, a receiving portion which receives a reflection beam of light as a reflection of the emitted beam of light from the thread, and a light shielding device provided between the emitting portion and the receiving portion for the prevention of entrance of light into the receiving portion except for the reflection beam of light;

data reading means for reading embroidering data relating to the embroidering pattern;

comparing device matching a color indication included in the embroidering data with the color of each of the threads which is recognized by the color recognizing device, the comparing device selecting one of the threads to which the thread of the matched color is routed for determining the selected needle;

control means for controlling the selected needle of the embroidery stitching mechanism and the frame to produce an embroidering pattern on the work-piece with the matched color thread.

2. An embroidering machine as set forth in claim 1, wherein the color recognizing device is adjustable relative to the corresponding thread.

3. An embroidering machine as set forth in claim 1, wherein the light shielding device is in the form of a cylindrical member, the emitting portion is placed at an inside portion of the cylindrical member, and the receiving portion is placed at an outside portion of the cylindrical member.

4. An embroidering machine comprising:

a thread station at which a plurality of spools of different colored threads are installed;

a frame on which a work-piece is carried in tension mode;

an embroidery stitching mechanism having one needle to which one of the colored threads is routed and stitching the work-piece therewith;

a color recognizing device for recognizing the color of the thread routed to the needle, the color recognizing device including an emitting portion from which a beam of light is emitted to a corresponding thread, a receiving portion which receives a reflection beam of light as a reflection of the emitted beam of light from the thread, and a light shielding device provided between the emitting portion and the receiving portion for the prevention of entrance of light into the receiving portion except for the reflection beam of light;

data reading means for reading embroidering data relating to the embroidering pattern;

control means for controlling the selected needle of the embroidery stitching mechanism and the frame to produce an embroidering pattern on the work-piece with the matched color thread; and comparing device matching a color indication included in the embroidering data with the color of the thread which is recognized by the color recognizing device, the comparing device allowing the control means to operate if the matching reveals that the color indication is in coincidence with the thread color.

5. An embroidering machine as set forth in claim 4, wherein the color recognizing device is adjustable relative to the corresponding thread.

6. An embroidering machined as set forth in claim 4, wherein the light shielding device is in the form of a cylindrical member, the emitting portion is placed at an inside portion of the cylindrical member, and the receiving portion is placed at an outside portion of the cylindrical member.

* * * * *